United States Patent [19]

Cerri

[11] Patent Number: 5,046,218

[45] Date of Patent: Sep. 10, 1991

[54] NOZZLE INTEGRATING ASSEMBLY FOR VACUUM CLEANERS

[76] Inventor: David D. Cerri, 1505 Paula Dr., Silver Spring, Md. 20903

[21] Appl. No.: 436,683

[22] Filed: Nov. 15, 1989

[51] Int. Cl.[5] ..... A47L 9/06

[52] U.S. Cl. ..... 15/416; 15/398; 15/417

[58] Field of Search ..... 15/328, 329, 330, 331, 15/334, 335, 336, 337, 338, 344, 416, 417, 257 A, 415 R, 418, 419, 421, 407, 414, 367, 393, 398, 400, 402; 285/7

[56] References Cited

U.S. PATENT DOCUMENTS

| | | | |
|---|---|---|---|
| 3,936,905 | 2/1976 | Stewart et al. | 15/416 |
| 3,942,216 | 3/1976 | Minton | 15/419 |
| 4,011,624 | 3/1977 | Proett | 15/415 R |
| 4,447,931 | 5/1984 | Lindqvist | 15/419 |
| 4,610,047 | 9/1986 | Dick et al. | 15/328 |
| 4,688,294 | 8/1987 | Simonsson | 15/417 |
| 4,723,338 | 2/1988 | Ostubo | 15/331 |
| 4,776,059 | 10/1988 | Wörwag | 15/416 |

FOREIGN PATENT DOCUMENTS

| | | | |
|---|---|---|---|
| 642989 | 6/1962 | Canada | 15/414 |
| 3309162 | 9/1984 | Fed. Rep. of Germany | 15/416 |

*Primary Examiner*—Philip R. Coe
*Assistant Examiner*—Charles E. Cooley
*Attorney, Agent, or Firm*—Richard C. Litman

[57] ABSTRACT

A vacuum cleaner nozzle assembly which integrates various nozzle styles into one compact, lightweight unit, thus ameliorating problems associated with their storage and use. Tool selection entails orienting valve components so as to direct air flow through the chosen nozzle only, while the others remain folded out of the way. The arrangement, if used in conjunction with a telescoping wand, will obviate the need for removing-/replacing nozzles or wand extensions in the great majority of cleaning situations, supersede separate tool storage, and thus ease and simplify vacuum cleaner use. If space restrictions require, as when cleaning a confined area, the integrated assembly of a preferred embodiment can be removed from the wand, and the brush or crevice tool removed from the assembly and placed on the wand, in the conventional manner.

18 Claims, 4 Drawing Sheets

FIG. 2
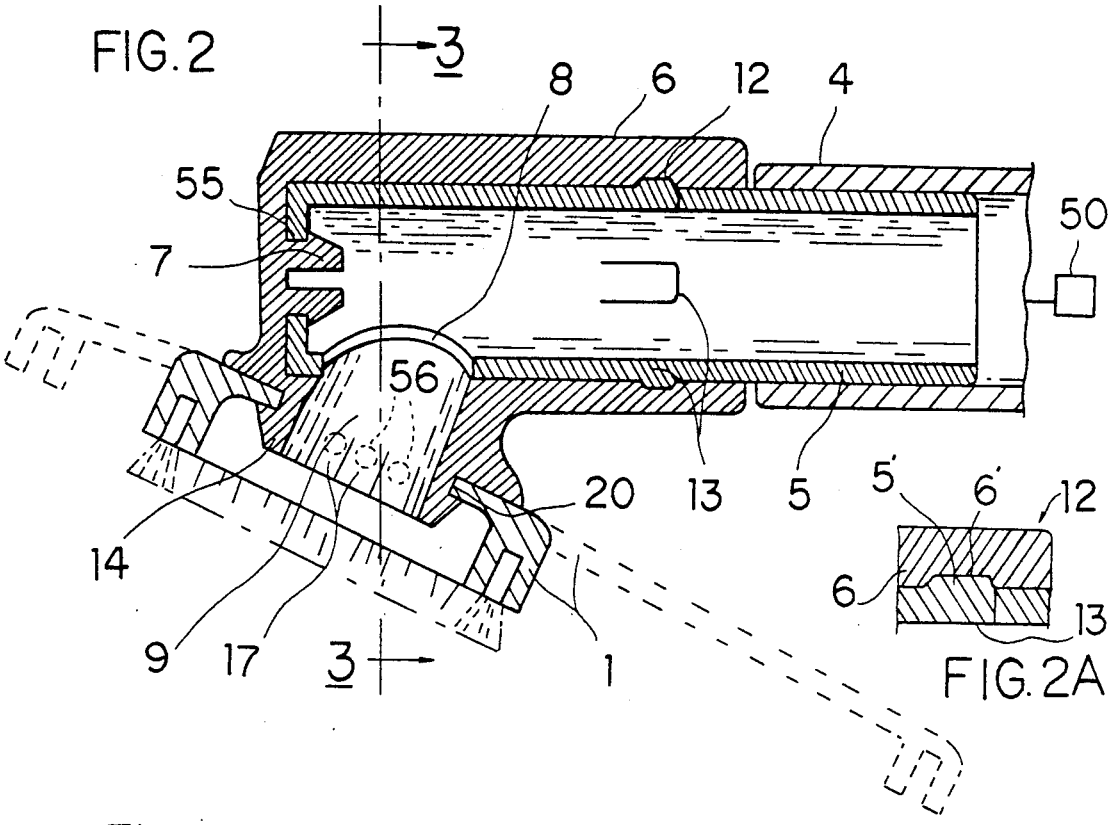
FIG. 2A
FIG. 3
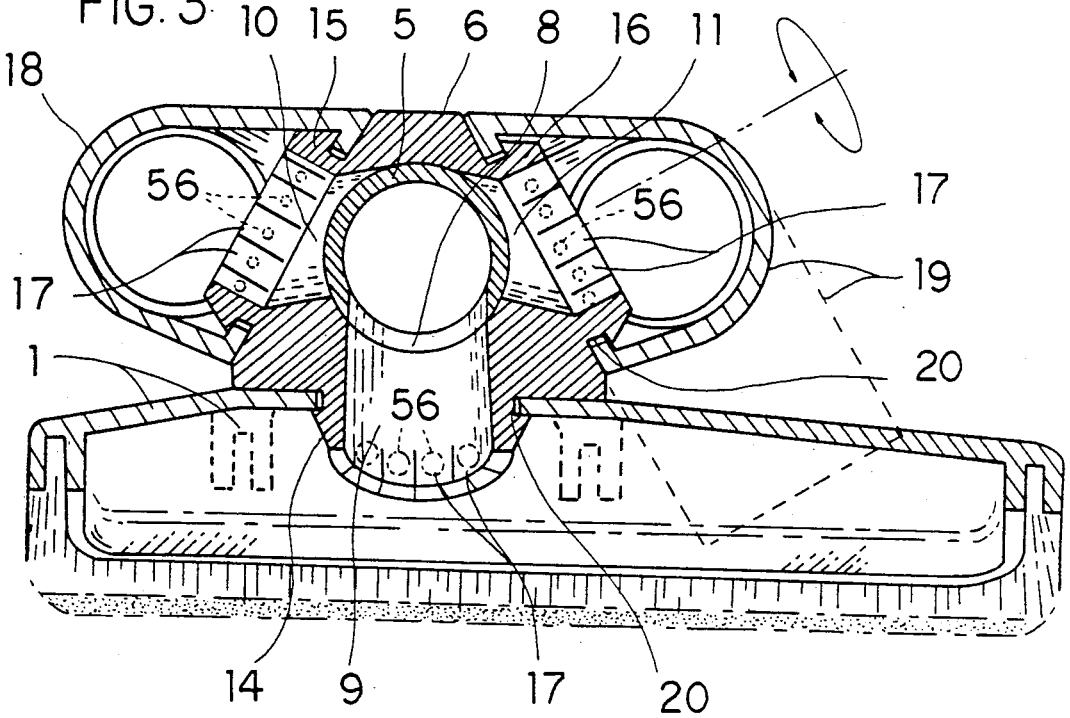

NOZZLE INTEGRATING ASSEMBLY FOR VACUUM CLEANERS

BACKGROUND OF THE INVENTION

Vacuum cleaner nozzles are designed in a variety of ways, the basic styles being carpet/floor tools, brush tools, and crevice tools. These attachments add to the machine's versatility but also, unfortunately, require frequent removal and interchange and, in addition, present considerable storage problems. Racks or fitted holders are built on or into the cases of many vacuum cleaners in an effort to keep the machine and its nozzles in one place. Other machines are provided with a storage box or bag for that purpose, and some, not even that. As a result, a particular tool is often difficult to locate when needed, and occasionally one is damaged during its solitary existence (sometimes as a result of having its own machine set down on it when it was returned to the closet). Finally, changing to another tool requires retrieving it from the closet, or at least from the holder on the back of the machine.

The prior art contains many examples of individual nozzle design but nowhere, to my knowledge, has a comprehensive solution to the aforesaid problems been proposed.

SUMMARY OF THE INVENTION

It is an object of the present invention, therefore, to obviate the need for physically separating any nozzle/-tool from the vacuum cleaner, even when changing the tool to be used.

Another object of the present invention is to conveniently locate the various nozzle/tools together at the point of use, in one compact lightweight configuration.

An additional object of the present invention is to allow any nozzle/tool integrated thereon to approach as closely as possible the utility it has when used alone on the hose/wand or hand-held machine, in the conventional manner (i.e. unimpeded by the proximity of other tools).

A further object of the present invention is to provide an integrated nozzle assembly of simple construction, so that it can be easily and inexpensively manufactured and assembled.

According to the present invention, there is provided means whereby two or more vacuum cleaner nozzle/-tools may be combined into one integrated unit, wherein the various nozzle/tools are connected to the vacuum source by way of one or more airflow controlling or diverting valve means, which can be adjusted so that any of the nozzles can interchangeably be given exclusive access to the airflow, without any nozzle having to be removed from the unit.

The elements of the valve means may be discrete parts, or may incorporate or be made integral or unitary with, housings, ducts, partitions, or other parts of the assembly or the nozzles themselves.

The operating mode of the valve means can be determined by manually changing the orientation of the unit or its constituent sub-assemblies relative to each other or to the vacuum cleaner, its hose or wand, as in the embodiments described herein; however, valve actuation could also be effected by other means (e.g. electrical solenoid), or by some other manual means perhaps employing knobs or levers.

The nozzles may be made so as to be removable, non-removable, unitary with, or any combination thereof, relative to the rest of the assembly, and two or more nozzle/tools can be further integrated into a single unit or sub-assembly. Also, the unit as a whole may be made so as to be removable or non-removable with regard to the vacuum cleaner, its hose, or wand. The assembly could also be made adaptable for retrofit to any vacuum cleaner hose or wand. Furthermore, the assembly could be adapted for use on a hand-held vacuum cleaner machine which may operate and/or be recharged from household line current, or operate from an automobile power system.

It is understood that there are many ways in which various nozzles can be arranged, airflow routed, and valve actuation accomplished, the embodiments described hereinafter being only representative examples of myriad possible designs.

BRIEF DESCRIPTION OF THE DRAWINGS

The invention is described in greater detail hereinafter relative to non-limitative embodiments and with reference to the attached drawings, wherein:

FIG. 2 is a longitudinal section view;

FIG. 2A is an enlarged detail view of detent 12 shown in FIG. 2;

FIG. 3 is a cross-section view along line 3—3 of FIG. 2;

DETAILED DESCRIPTION

Figure 1:
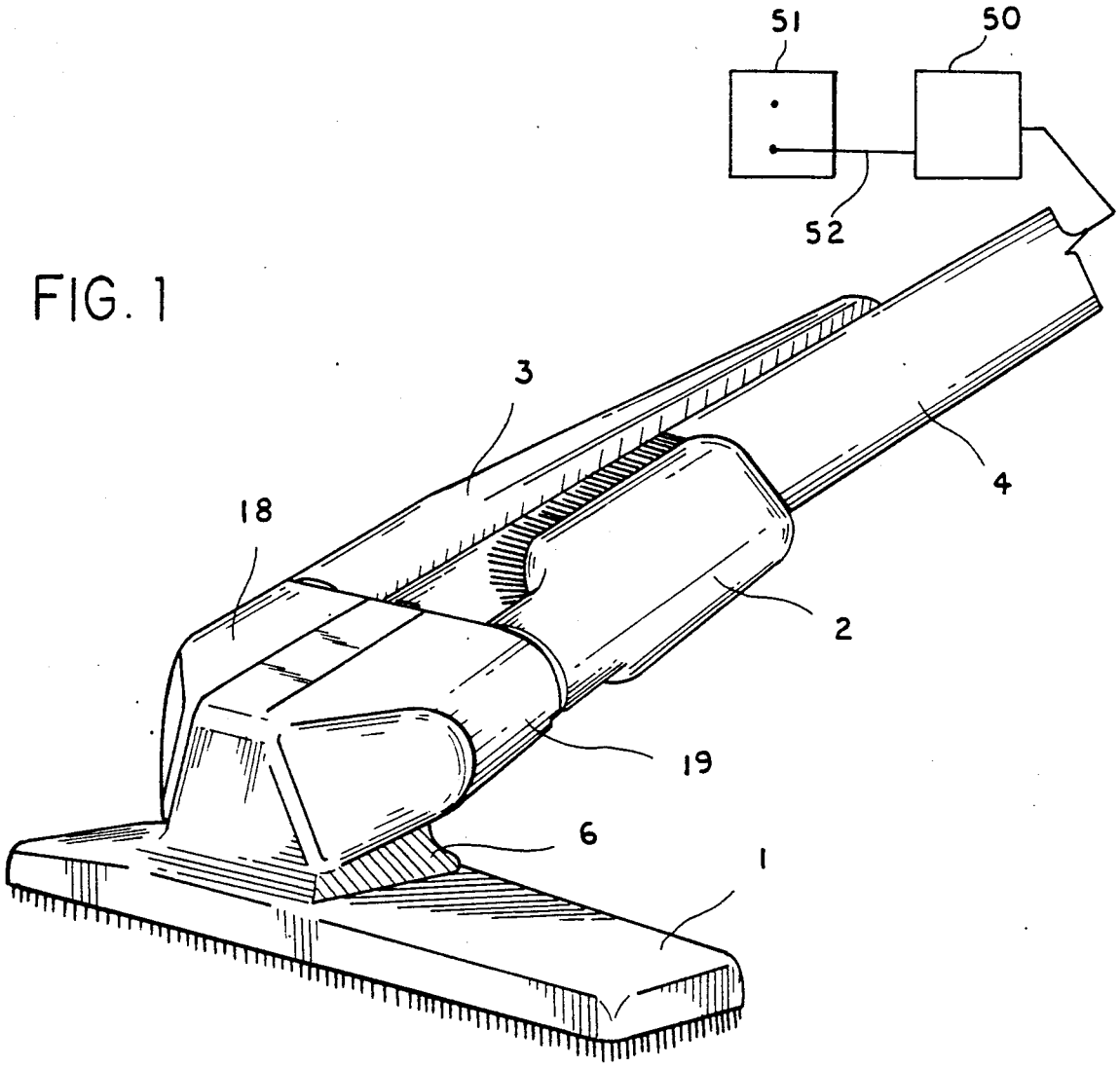
FIG. 1 is a perspective view of an integrated nozzle assembly for vacuum cleaners in accordance with the present invention.

Referring now to the drawings, in FIG. 1 is shown an example of a nozzle integrating assembly for vacuum cleaners embodying principles of the present invention. The example shown integrates three commonly used nozzle/tool styles: a carpet/floor tool 1, a small brush tool 2, and a crevice tool 3. The unit's central components comprise a multiport valve means 6,8,9,10,11 which allows air to be drawn exclusively through any one of the tools.

FIG. 2 is a section view showing the vacuum cleaner hose or wand 4 attached to an extended portion of an axial tube 5 by a light press fit, enabling the integrated unit to be removed, if necessary, from the wand, although some other method of attachment could be employed, or said tube made integral with the wand.

Tube 5 passes almost completely through manifold 6 and is retained therein by means of a barbed projection 7 molded into the closed end of the cylindrical cavity in manifold 6, said projection passing through an opening 55 in the otherwise closed end of tube 5 during manufacture/assembly, said barbs engaging and thus retaining the tube 5 within manifold 6, but leaving the manifold and tube free to rotate with respect to each other.

Tube 5 is, therefore, effectively closed to airflow at the end farthest from a conventional vacuum source 50 connected to an independent power source such as an AC electric socket 51 by wire 52, having instead an opening in its side 8, hereinafter referred to as the primary port.

Referring to FIG. 3, it can be seen that manifold 6 has congruent openings 9,10,11, hereinafter referred to as secondary ports, on sides which revolve about the aforesaid axis of tube 5 so that in operation, any of the secondary ports 9,10,11 can be reciprocally aligned with primary port 8 by rotating the manifold 6 and tube 5 relative to one another, thus allowing airflow to be directed through any of the peripheral faces on manifold 6. (Note: all figures showing the primary port 8, depict it as being aligned with that secondary port 9 serving the floor tool 1.) At FIG. 3, the floor tool 1 is shown directly connected to secondary port 9, while the other tools are shown connected to side ducts 18, 19, which side ducts are not shown at FIG. 2 but are evident in FIG. 1. It is envisioned that a nozzle may be directly connected at port 9, such as shown with floor tool 1, which is most frequently used when vacuuming, while less frequently used tools could be attached by way of side ducts 18, 19.

The chosen alignment of ports is maintained by detents 12 when bumps 5' and corresponding concave dimples 6' are molded into the outer surface of the axial tube 5 and the interior surface of the manifold 6, repectively. The wall of axial tube 5 is notched around the bumps 5' in such a way as to form tabs 13 with the bumps 5' at the unattached ends. The bumps' resultant spring-loading against the interior surface of manifold 6, and their consequent snap fit into the dimples when a given alignment is reached, effectively locks the alignment in place, yet yields to the force of intentional readjustment.

Molded into the outer surface of the manifold 6, around each of the secondary ports 9,10,11, are unions 14,15,16, which are comprised of barbed tabs 17, which allow rotation of the tool and side ducts thereabout. When inserted through corresponding openings on the floor tool 1 and the two side ducts 18,19, said barbs engage therein, thus retaining said tool and ducts against the outer surface of manifold 6, in a manner which allows each to be pivoted with respect to the manifold while gaining access to airflow therefrom. FIG. 3 (phantom) shows one duct 19 rotated about its axis (marked by arrows), downward 90° with respect to the other duct 18. The brush tool 2 and a crevice tool 3 are shown in FIG. 1 attached to the ducts 18,19 in the preferred embodiment, via light press fits, allowing either one to be removed for separate use; however, other methods of retention could be employed, or said tools could be made integral with the ducts. In an effort to lower the profile of the device, a downward displacement has been imparted to the laterally situated secondary ports 10,11 and their associated unions 15,16 and ducts 18,19 (FIG. 3).

The operative position of the floor tool 1 is considered to be that where the major (lengthwise) axis of the tool is proximally perpendicular to that of wand 4, as shown in FIGS. 2 and 3 by the solid outline, although it could be used in other orientations as well to facilitate vacuuming less accessible areas of the floor.

Conversely, the floor tool's 1 normally inoperative position is considered to be that where the tool's major axis is proximally parallel to that of wand 4, represented in FIGS. 2 and 3 by the appropriate dotted outlines. When in this position it poses no obstruction to the side ducts 18,19 or their attached tools, being rotated to any angle relative to manifold 6.

The brush 2 and crevice 3 tools are considered to be in their preferred operative orientation when the ducts 19,18, to which they are fitted, are rotated to a fully forward position, 180° from the positions they are shown to have in FIG. 1, that figure depicting them, instead, in their preferred inoperative positions.

The preferred operative and inoperative positions of each duct/tool are maintained by grooves 20 which are formed under the shoulders of the barbs in the exterior axial surfaces of barbed tabs 17 in which grooves 20 and barbed tabs 27 form the unions 14, 15, 16. Each such tab inherently provides spring loading whereby the bump portions 56 on each tab 17, similar to bumps 5' in FIG. 2, are provided along the circumferential base of grooves 20, which bump portions snap into reciprocal dent portions similar to dimples 6' in FIG. 2, the dent portions being formed in the inner surface of the mating portion of tool 1 and ducts 18 and 19, wherein said duct/tools are engaged and retained, when a corresponding operative or inoperative position is reached. In this way duct/tool positions can be changed or locked at will. Moreover, tools fitted to the ducts 18,19 may be radially adjusted therein, allowing further adaptation to a particular cleaning situation.

When the floor nozzle 1 is in the inoperative position, its asymmetrical orientation relative to its secondary port 9, allows reduced forward projection of same, thus lessening any hindrance it may pose to the operation of other tools. To prevent the floor nozzle's 1 chosen position being altered by impacts with baseboards, furniture, etc., its secondary port 9 could be provided with extra and/or deeper grooves 20 for greater stability, or some other means for locking its position could be employed. Airflow between the long and short ends of the tool, as measured from the secondary port 9, could be equalized by the use of baffles, which modern carpet/-floor tools already commonly incorporate. Alternatively, the floor tool could be centered relative to its secondary port 9.

Also, when using the floor tool 1 with an extension wand 4 it will be advantageous to the operational efficiency of the tool, and to the ease of its use, to build into the integrating assembly some means whereby the angle subtended between the wand 4 and the floor can be accommodated. In keeping with the effort to minimize the unit's overall dimensions, and to further simplify design, the preferred embodiment has incorporated a fixed angle into the configuration of the manifold 6 for this purpose, although a pivoting or jointed duct could be employed as well, preferably situated between the wand 4 and manifold 6.

Vacuum cleaner use entails not only deciding which nozzle to use, but also how the nozzle is to be attached, whether to the flexible corrugated hose, or to one or more wand extensions. For this reason, and keeping in mind the objects of the invention, it can be seen that any nozzle integrating unit will achieve its maximum utility if used in conjunction with a telescoping wand, which would normally be fully extended when cleaning a floor, for example, but may also be compressed to a minimum length for closer work, thus making it unnecessary to remove or replace any attachments whatsoever, in the great majority of cleaning situations.

If a particular design of nozzle integrating assembly requires torsional motion of the wand as an adjunct to tool selection, it may be favorable, depending on how much resistance the hose offers to such motion, to include a union at some point between the assembly and said hose.

The constituent sub-assemblies of the invention could be molded of ABS, polycarbonate, or other plastics typically employed in vacuum cleaner nozzle construction, and styling of the individual nozzles could be such as to complement and further visually integrate the unit.

According to the preferred embodiment, once the sub-assemblies are fabricated, they can quickly and easily be assembled by simply snapping four parts (the axial tube 5, the two side ducts 18,19, and the floor tool or nozzle 1) onto the manifold 6.

The unit, or a variation thereof, if provided with suitable adapting means whereby various commonly used hose/wand diameters can be accommodated, could even be retrofitted to existing vacuum cleaners.

Figure 4:
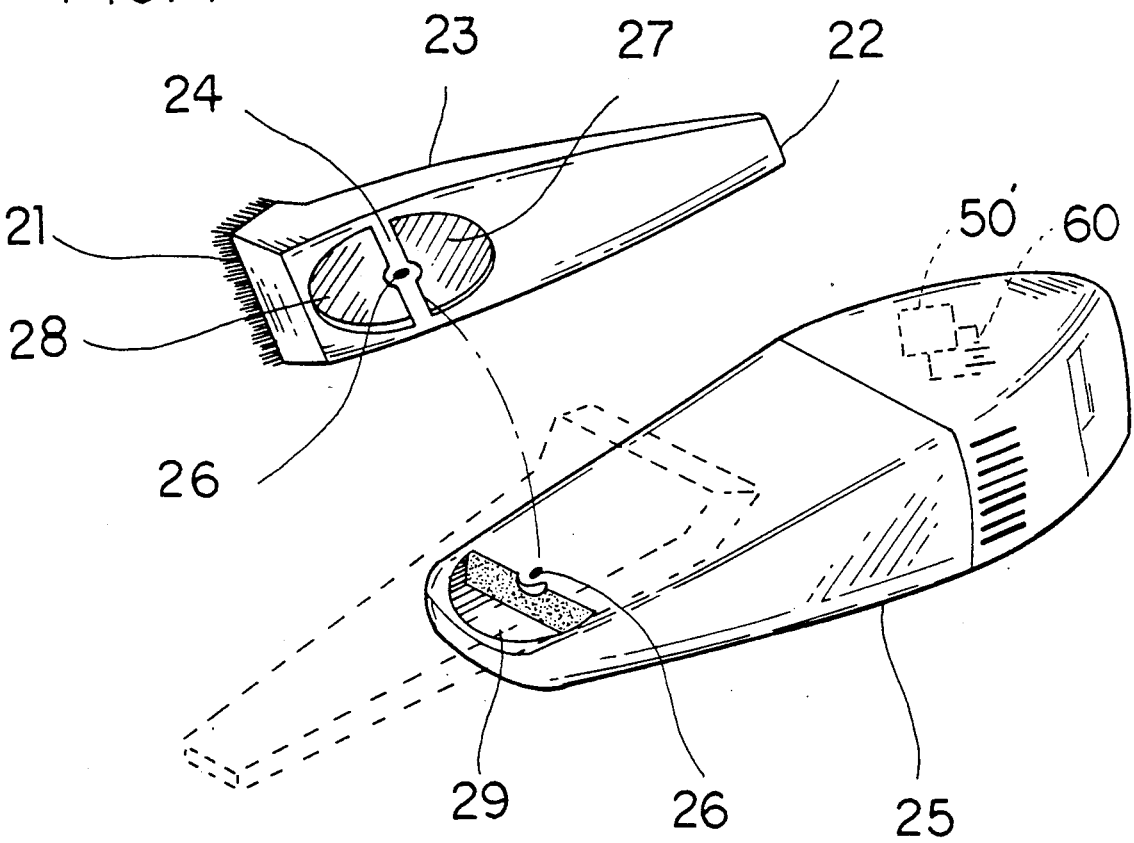
FIG. 4 is an exploded perspective view of a nozzle integrating assembly attached to a hand-held vacuum cleaner.

Another embodiment of the present invention, represented in FIG. 4, shows a hand-held vacuum cleaner (inverted) with two integrated nozzles, adapted by an alternative arrangement for aligning valve ports.

In this example, a brush nozzle 21 and a crevice nozzle 22 have been further integrated into a single moving part or sub-assembly 23, wherein each one's airflow is separated from the other's by means of an interior partition 24. The integrated nozzle assembly 23 and the vacuum cleaner 25 having a conventional vacuum source 50' connected to a convention independent battery 60 are joined by a shoulder bolt or other fastener, between the two points 26 shown connected by the arched broken line, in such manner that the nozzle assembly 23 may be rotated end for end about the axis 26, thus permitting alignment of either the crevice nozzle's secondary port 27, or the brush nozzle's secondary port 28, with the primary port 29.

The chosen tool position could be maintained by detent devices, as described earlier, or other locking means.

The integrating unit could be made so as to be removable, if desired, when, for example, the machine is to be used in wet (wet/dry) mode.

Figure 5:
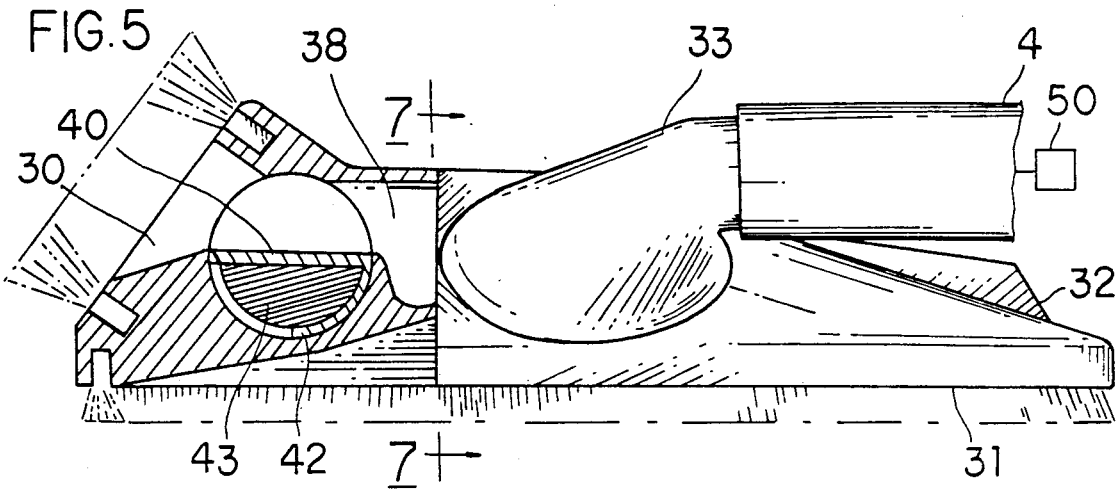
FIG. 5 is an elevational view of a further embodiment of the invention, including a partial longitudinal section along line 5—5 of FIG. 6.
Figure 6:
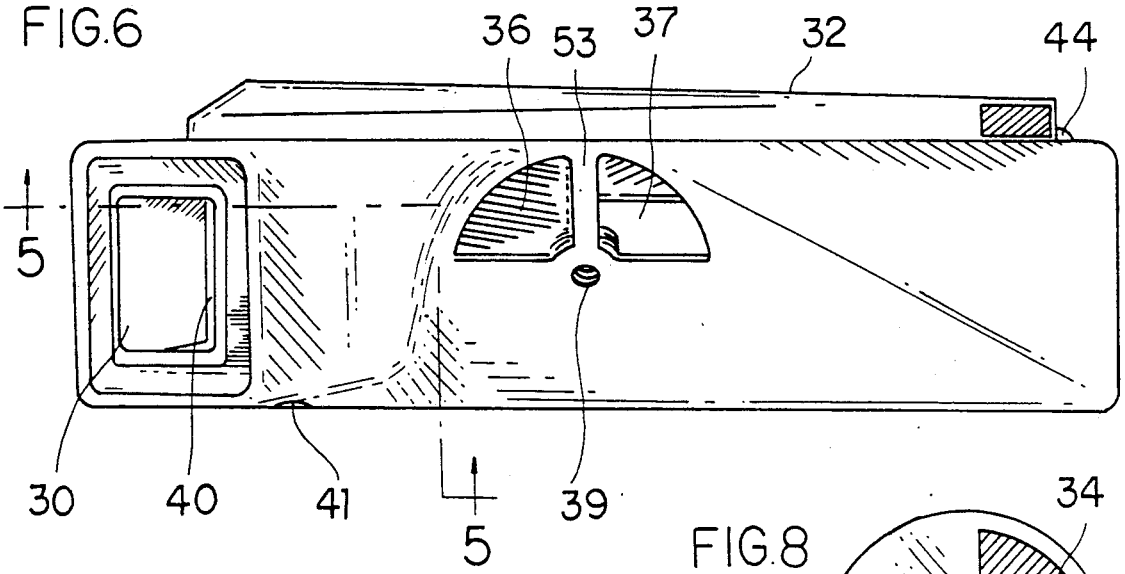
FIG. 6 is a plan view, with both the brush nozzle's bristles and the plenum removed.
Figure 7:
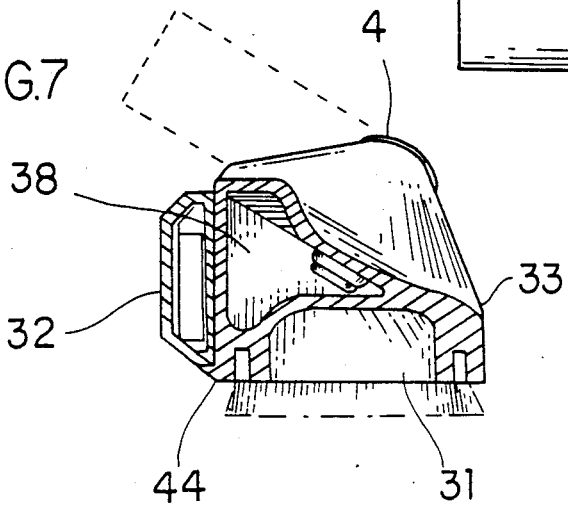
FIG. 7 is a cross-section view along line 7—7 of FIG. 5.

A further embodiment of the present invention again integrates floor, brush, and crevice tools, and is shown in FIGS. 5, 6, and 7.

Figure 8:
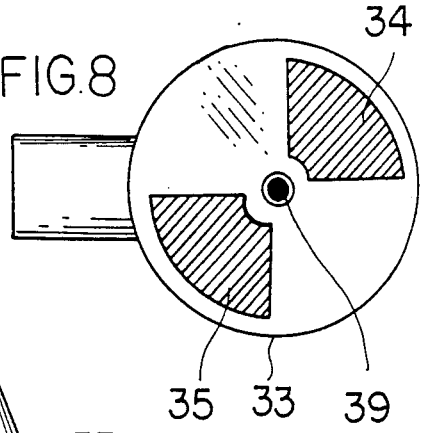
FIG. 8 is an elevational view of the underside of the plenum.

In this example, the brush nozzle 30 and floor nozzle 31 have been made unitary with one another and with the main body of the assembly, and the crevice tool 32 is articulated relative to same, but not removable therefrom. The assembly is attached to the hose/wand 4 by an extended portion of plenum 33. Two primary ports 34,35 occupy diametrically opposed quadrants of the circular lower surface of the plenum 33 (FIG. 8), whereon it interfaces the main body of the assembly. The assembly has secondary ports 36,37 separated by a wall 53 occupying the two upper quadrants of its circular area of interface with said plenum 33 (FIG. 6), port 36 opening to lateral duct 38, and port 37 opening directly to the floor nozzle 31. (Note: Due to space considerations, the brush nozzle bristles have been omitted from FIG. 6). A shoulder bolt or other fastener attaches the plenum 33 to the rest of the assembly at a central point 39 in such a way as to provide an axis about which the assembly can be rotated with respect to the plenum 33 and wand 4.

When the assembly's major (lengthwise) axis is made perpendicular to that of the wand 4 (FIG. 7, phantom) airflow is directed through primary port 35, via that secondary port 37 which serves the floor nozzle 31, thus allowing operation of said floor nozzle. Primary port 34 is inoperative as, in this mode, it is not aligned with either secondary port.

Alternatively, when the major axis of the assembly is parallel to the wand 4, air is directed through primary port 34, via secondary port 36 which serves the lateral duct 38, in turn serving both the brush 30 and crevice 32 nozzles. Primary port 35 is inoperative in this mode, since it is now unaligned with either secondary port.

The top surface of the assembly to which the plenum 33 is attached, is inclined so that when said assembly is oriented for floor tool use, the angle subtended between the floor and the wand 4 is accommodated. The inclined interface also provides that, when either the brush 30 or crevice 32 tool is used, the assembly's major axis will lie parallel, and as close as possible to, that of the wand 4, thus allowing operation of either said tool to closely match that of an equivalent tool used alone on a wand, as per the conventional manner.

The lateral duct 38, if traced from its secondary port 36 towards the brush nozzle 30, first deepens, partially filling the upper and rearward portion of the floor nozzle's inner concavity, then simultaneously ascends and widens to the full width of the brush nozzle inlet. In this way the cross sectional area available to airflow is kept relatively constant. Before the duct 38 reaches the brush nozzle 30, it is intersected by the upper longitudinal half of valve element 40, said element being unitary with the crevice tool 32. The unitary valve element/crevice tool (40/32) is attached to the assembly by means of a shoulder bolt 41 or other fastener which provides an axis about which said tool can be pivoted relative to the assembly. The valve element 40 is formed in a such a manner that, when the crevice tool 32 is in its inoperative position (i.e. folded against the assembly) as shown in the drawings, no obstruction is posed to airflow between the brush tool 30 and secondary port 36. When, however, the crevice tool 32 is pivoted 180° to its operative position, a partition 42 on the valve element 40 cuts off airflow from the brush tool 30, and redirects it instead through the crevice tool 32, via a semicircular port 43 located on that surface where the crevice nozzle 32 and valve element 40 are united.

To prevent the crevice nozzle being dislodged from its inoperative position when the wand 4 is made substantially parallel to the floor, as when cleaning under a sofa, the lower edge 44 of the assembly may be extended outward, under said nozzle, so as to keep it from touching the floor.

Preferred operative and inoperative positions of the various nozzles could be maintained or locked in the manner previously set forth.

As in the case of the first embodiment described, this integrating assembly will also achieve its greatest utility when used on a telescoping wand with a union placed at some point between the integrating unit and the corrugated hose, as the assembly will be inverted for brush tool use.

While the present embodiments do not lend themselves to easy disassembly, some provision could be made to that end, in order to allow cleaning of fibrous material from valve elements, articulated joints, etc.

The use of resilient seals at rotating junctions and/or port interfaces on all embodiments described herein, while not necessary, will serve to minimize or prevent any leakage at those areas.

For the sake of simplicity, an attempt has been made, in all designs described herein, to combine the motion required for valve actuation with the motions inherent in nozzle/tool selection; however, it is understood that a multitude of other designs are possible which could make use of separate valve actuators such as knobs, buttons, or levers, or electrical devices such as linear or rotary solenoids. Other advantages may also be conferred by the use of additional mechanical linkages, push-pull cables, etc.

The present embodiments of the invention are not to be considered in any respect restrictive, but rather, merely illustrative of its basic principle. The spirit and scope of the invention is more clearly indicated by the appended claims than by any of the foregoing descriptions. All changes which may be construed to fall within the meaning and range of equivalency of the following claims, therefore, are intended to be embraced therein.

What is claimed:

1. A nozzle assembly for connection to a vacuum source which supplies a flow of air, comprising one or more nozzle means, each said nozzle means having a functional end and an attachment end; and multiport valve means for directing air flow therethrough, said valve means including a manifold having an interior formed as a cylindrical cavity, said cavity having an open end and an opposed closed end, the interior wall of said cavity including spaced indentations along a peripheral portion proximate said open end which forms concave dimples therein at substantially regular intervals placed transversely about the inner circumference of the interior wall of the cavity, the interior wall of said closed cavity and formed with central resilient projections with outwardly extending barbs on the free ends thereof, said valve means including ports formed in the walls thereof adjacent said manifold cavity closed end, each said port having one end open to said cavity and an opposed end open to the exterior of said valve means, and union means formed at said exterior openings of said ports for rotationally displaceable connection of said attachment ends of said nozzle means to said exterior openings of said ports; and tube means having an exterior substantially complementary to the interior of said manifold cylindrical cavity and rotationally displaceable therein, said tube means having an open end complementary to said open end of said manifold cavity and extending therebeyond for connection to said vacuum source, said vacuum source including connection means, and a closed end with a central opening therein, the wall of said tube means including resilient tabs formed therein at the approximate midpoint of said tube means, the exterior of said tabs having protuberances on the free ends thereof which form bumps positionally aligned with said manifold cavity dimples, said tube means positionally maintained within said cavity by said barbs of said cavity projections tensionally retaining the interior periphery of said central opening in said tube means closed end and said bumps being seated within said cavity dimples, said tube means including an air flow opening formed in the wall thereof adjacent said closed end which is aligned with each of said cavity port openings upon rotational positioning of said tube means; whereby said tube means is forcibly appropriately rotated within said manifold to align said tube means air flow opening with one of said cavity port openings, thereby positioning solid portions of said tube means wall across any other said cavity port opening to substantially cover and close all other said port openings and said bumps seat in corresponding dimples to displaceably retain said tube means in said rotated position, whereby air flow occurs only through the respective nozzle means connected to said one cavity port opening aligned with said tube means air flow opening and all other cavity port openings are covered and closed by said solid tube means wall.

2. The assembly of claim 1 wherein all said nozzle means are detachably connected to said multiport valve means.

3. The assembly of claim 2 wherein duct means is provided, said duct means having one end connected for rotational displacement at said union means of said exterior port opening and an opposed end for connection to said attachment end of one of said nozzle means.

4. The assembly of claim 3 wherein said union means include said resilient projections with extending barbs formed on the periphery of said exterior port openings and a groove formed in the exterior axial faces of said projections.

5. The assembly of claim 1 wherein all said nozzle means are integrally formed with said multiport valve means.

6. The assembly of claim 5 including at least one nozzle means having an interior for air flow therethrough, a functional end, and an attachment end for rotatably displaceable connection to one of said integral nozzle means proximate said functional end of said one of said integral nozzle means, said attachment end of said at least one nozzle means including integral valve means and partition means positioned in said nozzle interior of said one of said integral nozzle means, said valve means allowing air flow therethrough in said one of said integral nozzle means when said at least one nozzle means is in an inoperative position, and said partition means closes said functional end of said integral nozzle means when said at least one nozzle means is rotated to an operative position and said partition allows vacuum air flow only through said at least one nozzle means.

7. The assembly of claim 1 wherein at least one of said nozzle means is integrally formed with said multiport valve means.

8. The assembly of claim 1 wherein said assembly is detachably connected to said vacuum source.

9. The assembly of claim 1 wherein said assembly is integrally connected with said vacuum source.

10. The assembly of claim 1 wherein two or more of said nozzle means are integrally formed as a single part.

11. The assembly of claim 10 wherein said union means include said resilient projections with extending barbs formed on the periphery of said exterior port openings and a groove formed in the exterior axial faces of said projections.

12. The assembly of claim 1 wherein said vacuum source includes an independent power source.

13. The assembly of claim 1 wherein said vacuum source is electrically energized by an AC power source.

14. The assembly of claim 1 wherein said multiport valve means is manually actuated.

15. A nozzle assembly for connection to a vacuum source which supplies a flow of air through a vacuum flow opening, comprising integral nozzle means including at least two nozzles, each said nozzle having a functional end, an interior for directing air flow therethrough and at least one wall distal from said functional end and common to at least two of said nozzles, each said nozzle interior having an air flow port formed therein adjacent said common wall, said integral nozzle means including attachment means formed on the exterior of said common wall for rotatable displacement and connection to said vacuum source, each said air flow port of said integral nozzle means and the vacuum flow opening of said vacuum source being substantially the same configuration, whereby rotation of said integral nozzle means upon said vacuum source aligns only one said integral nozzle air flow port with said vacuum flow through the respective nozzle of said only one aligned air flow port aligned with said vacuum flow opening.

16. An assembly as claimed in claim 15 including plenum means having an end thereof connected to said vacuum source and an opposed end having attachment means for rotatably displaceable abutting connection to said integral nozzle means, said plenum having an interior for directing air therethrough, said interior including at least one air flow port formed in said end with said attachment means, and rotational displacement of said integral nozzle means aligns one said nozzle interior air flow port with said plenum air flow port, whereby vacuum air flow occurs only through the respective nozzle of said one nozzle interior air flow port aligned with said air flow port in said attachment end of said plenum means.

17. The assembly of claim 16 including at least one nozzle means having an interior for air flow therethrough, a functional end, and an attachment end for rotatably displaceable connection to one of said integral nozzle means proximate said functional end of said one of said integral nozzle means, said attachment end of said at least one nozzle means including integral valve means and partition means positioned in said nozzle interior of said one of said integral nozzle means, said valve means being configured to selectively direct air flow therethrough when said valve means is suitably positioned, said valve means allowing vacuum air flow therethrough in said one of said integral nozzle means when said at least one nozzle means is in an inoperative position, and said partition means closing said functional end of said integral nozzle means when said at least one nozzle means is rotated to an operative position and said valve means directing vacuum air flow only through said at least one nozzle means.

18. The assembly of claim 17 wherein said interiors of said at least one nozzle means and said integral nozzle means include interior walls, said walls having a configuration such that air flow is constant through each of said integral nozzle means when directed therethrough.

* * * * *